United States Patent [19]

Nakamura et al.

[11] 4,162,188

[45] Jul. 24, 1979

[54] PROCESS FOR PRODUCING PULP

[75] Inventors: Masato Nakamura; Yoshika Nomura; Tamio Katori, all of Tokyo, Japan

[73] Assignee: Honshu Seishi Kabushiki Kaisha, Tokyo, Japan

[21] Appl. No.: 829,005

[22] Filed: Aug. 30, 1977

[30] Foreign Application Priority Data

May 18, 1977 [JP] Japan ..... 52/57275

[51] Int. Cl.[2] ..... D21C 3/02

[52] U.S. Cl. ..... 162/76; 162/82; 162/83; 162/90; 162/72

[58] Field of Search ..... 162/65, 72, 76, 77, 162/82, 83, 90

[56] References Cited

U.S. PATENT DOCUMENTS

| | | | |
|---|---|---|---|
| 2,730,444 | 1/1956 | Hodge et al. | 162/76 |
| 3,769,152 | 10/1973 | Samuelson et al. | 162/65 |
| 4,012,280 | 3/1977 | Holton | 162/72 |

FOREIGN PATENT DOCUMENTS

| | | | |
|---|---|---|---|
| 51-43403 | 4/1976 | Japan | 162/72 |

*Primary Examiner*—S. Leon Bashore
*Assistant Examiner*—William F. Smith
*Attorney, Agent, or Firm*—Frishauf, Holtz, Goodman & Woodward

[57] ABSTRACT

A novel process for producing pulp is disclosed, by which cooking of lignocellulosic materials can be carried out advantageously in the presence of a novel cooking aid added to the cooking liquor. Representative examples of such cooking aids include maleic acid, sodium maleate, potassium maleate, maleic anhydride, fumaric acid, sodium fumarate, potassium fumarate, mesaconic acid and sodium mesaconate. Both cooking yield and quality of pulp are substantially improved. The cooking aids can be used in combination with dihydroxydihydroanthracene.

12 Claims, No Drawings

PROCESS FOR PRODUCING PULP

This invention relates to a process for the production of pulp. More particularly, the invention relates to a process for the production of pulp characterized in that in the cooking step for producing alkaline pulp, sulfite pulp and the like, a compound having in its molecule a group having the generic formula:

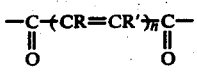

is added to the conventional cooking liquor for carrying out the cooking therewith. The term "alkaline cooking process" herein used includes various alkaline cooking processes such as a kraft process, a soda process, a sodium carbonate process and the like. Similarly, the term "sulfite cooking process" herein used includes various sulfite cooking processes such as an alkaline sulfite process, a neutral sulfite process, a bisulfite process and the like.

To improve the cooking yield as well as the quality of pulp is important in the production of pulp from lignocellulosic materials such as wood, bagasse, hemp and the like. It is indispensable to the economical production of good quality pulp with decreased consumption of raw material and of energy. Thus, the research to meet such demands has been made from old times. In fact, however, it is rather difficult to find a process which can meet both of said demands.

Accordingly, one object of the present invention is to provide a novel process for the production of pulp which brings about the improvement in both the cooking yield and the quality of pulp by employing as a novel cooking aid a specified type of organic compound, which has in its molecular structure a specified chemical group.

By carrying out the cooking of lignocellulosic materials according to the present invention in the presence of a small amount of the cooking aid of the present invention added to the alkaline or sulfite cooking liquor, the degradation and dissolution of cellulose and hemicellulose in the cooking process are avoided and as a result the quality of pulp as well as the cooking yield are improved. Said cooking aid comprises a compound having in its molecular structure a group having the formula:

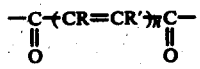

wherein R and R' each represents H or an alkyl group and n represents an integer of 1 through 3.

Representative examples of compounds which can be used as the cooking aids mentioned above in the practice of the present invention include maleic acid; alkali salts of maleic acid such as sodium maleate and potassium maleate; maleic anhydride; fumaric acid; alkali salts of fumaric acid such as sodium fumarate and potassium fumarate; mesaconic acid; alkali salts of methaconic acid such as sodium mesaconate, and the like. By carrying out the cooking in a conventional manner in the presence of at least one member selected from the compounds mentioned above and added to the cooking liquor in an amount of 0.005 to 1% by weight based on the bone dry weight of raw material for pulp to be cooked, the advantages of the present invention can be obtained. If the amount of the cooking aid added is less than 0.005% by weight, substantial advantage will not be obtained.

However, the addition of more than 1% by weight will be of no use, because the advantages thereby will not substantially exceed the advantages obtainable by the addition of 1% by weight. When a cooking aid is used in an amount of 0.01–0.1% by weight based on the same basis as mentioned above, the best results will be obtained. The process of the present invention can be carried out according to a conventional manner without any modification except that the novel cooking aid is added to the cooking liquor according to the standards mentioned above. The following examples will further illustrate the present invention.

EXAMPLE 1

600 g of soft wood chips were placed in a 4-liter capacity autoclave and a kraft process cooking liquor having 17% active alkali and 30% sulfidity was added thereto. Then, 0.02% by weight based on the bone dry weight of the chips of sodium maleate was added to the above mentioned cooking liquor and the cooking was carried out at 165° C. for 75 minutes.

For comparative purposes, other experiments were carried out in the same manner as mentioned above except that the addition of sodium maleate was omitted. The results of these experiments were as shown in Table 1 below.

Table 1

| | Kraft process cooking with sodium maleate (present invention) | Kraft process cooking without sodium maleate (prior art) |
|---|---|---|
| Cooking yield (%) | 48.0 | 46.4 |
| Kappa number | 50 | 50 |
| Burst factor* | 6.9 | 6.2 |
| Breaking length (Km)* | 8.2 | 7.0 |
| Tear factor* | 176 | 175 |

*determined by JIS P-8210 (Testing Method for Strength of Paper Pulp)

EXAMPLE 2

700 g of hardwood chips were placed in a 4-liter capacity autoclave, and a soda process cooking liquor having 16% of caustic soda was added thereto and then 0.05% by weight based on the bone dry weight of the chips of maleic anhydride was added to the resulting solution to carry out the cooking at 160° C. for 75 minutes.

On the other hand, another experiment was carried out in the same manner as above except that the addition of maleic anhydride was omitted. The results of these experiments were as shown in Table 2 below.

Table 2

| | Soda process cooking with maleic anhydride (present invention) | Soda process cooking without maleic anhydride (prior art) |
|---|---|---|
| Cooking yield (%) | 55.0 | 53.5 |
| Kappa number | 72 | 75 |
| Burst factor* | 4.0 | 3.3 |
| Breaking length (Km)* | 5.9 | 4.5 |

Table 2-continued

| | Soda process cooking with maleic anhydride (present invention) | Soda process cooking without maleic anhydride (prior art) |
|---|---|---|
| Tear factor* | 85 | 89 |

*determined by JIS P-8210 (Testing Method for Strength of Paper Pulp)

EXAMPLE 3

600 g of softwood chips were placed in a 4 l.-capacity autoclave and a kraft process cooking liquor having 17% of active alkali and 30% of sulfidity was added thereto, followed by further adding thereto 0.01% by weight based on the bone dry weight of the chips of sodium fumarate to carry out the cooking at 165° C. for 75 minutes.

On the other hand, for comparative purposes, another experiment was carried out according to a conventional kraft process under the same conditions as mentioned above except that the addition of sodium fumarate was omitted.

The results of these experiments were as shown in the following Table 3.

Table 3

| | Kraft process cooking with sodium fumarate (present invention) | Kraft process cooking without sodium fumarate (prior art) |
|---|---|---|
| Cooking yield (%) | 48.3 | 46.4 |
| Kappa number | 57 | 50 |
| Burst factor* | 7.0 | 6.1 |
| Breaking length (Km)* | 8.0 | 7.2 |
| Tear factor* | 173 | 175 |

*determined by JIS P-8210 (Testing Method for Strength of Paper Pulp)

EXAMPLE 4

350 g of flax was placed in a 4-liter capacity autoclave, and (1) a cooking liquor having 18% of sodium sulfite and 2% of caustic soda and (2) 0.05% based on the weight of the raw material of mesaconic acid were added thereto to carry out cooking at 180° C. for 5 hours.

On the other hand, for comparative purposes, another experiment was carried out in the same manner as mentioned above except that the addition of mesaconic acid was omitted. The results of these experiments were as shown in Table 4 below.

Table 4

| | Sodium sulfite process cooking with mesaconic acid (present invention) | Sodium sulfite process without mesaconic acid (prior art) |
|---|---|---|
| Cooking yield (%) | 62.7 | 59.1 |
| Kappa number | 12 | 13 |
| Burst factor* | 8.4 | 7.5 |
| Tear factor* | 170 | 170 |

*determined by JIS P-8210 (Testing Method for Strength of Paper Pulp)

The cooking aids of the present invention can be used in combination with dinydroxydihydroanthracene. When used in combination, the advantage exceeds the total of the advantages obtained in two cases wherein the cooking aid of the present invention and dihydroxydihydroanthracene are used, respectively. The following example will illustrate the advantage mentioned above.

EXAMPLE 5

600 g of softwood chips were placed in a 4 l.-capacity autoclave, and a kraft process cooking liquor having 18% of alkali and 25% of sulfidity was added thereto. Then, 0.005% by weight each, based on the bone dry weight of the chips, of dihydroxydihydroanthracene and sodium maleate were added to the cooking solution to carry out cooking at 170° C. for 75 minutes.

On the other hand, for comparative purposes, three similar experiments were repeated in the same way as mentioned above except that in each case 0.01% by weight, based on the bone dry weight of the chips, each of dihydroxydihydroanthracene or sodium maleate was used or neither of both was used instead of the combination of them.

The results of these experiments were as shown in the following Table 5.

Table 5

| | Kraft process cooking with dihydroxy dihydroanthracene (0.005%) plus sodium maleate (0.005%) | Kraft process cooking with dihydroxy-dihydroanthracene (0.01%) | Kraft process cooking with sodium maleate (0.001%) | Kraft process cooking with neither dihydroxy-dihydro-anthracene nor sodium maleate |
|---|---|---|---|---|
| Cooking yield (%) | 47.8 | 47.0 | 47.1 | 45.2 |
| Kappa number | 35 | 33 | 37 | 42 |
| Burst factor* | 6.5 | 6.2 | 6.5 | 5.7 |
| Breaking length (Km)* | 7.4 | 7.0 | 7.3 | 6.4 |
| Tear factor* | 150 | 155 | 150 | 150 |

*determined by this P-8210 (Testing Method for Strength of Paper Pulp)

EXAMPLE 6

700 g of hardwood chips were placed in a 4 l.-capacity autoclave, and a kraft process cooking liquor having 16% of active alkali and 25% of sulfidity was added thereto followed by further adding thereto 0.01 each, based on the bone dry weight of the chips, of dihydroxydihydroanthracene and sodium fumarate to carry out the cooking at 160° C. for 75 minutes.

On the other hand, for comparative purposes, similar experiments were carried out in the same manner as mentioned above except that 0.02% each based on the bone dry weight of the chips of dihydroxydihydroanthracene or sodium fumarate or neither of them was added to the cooking liquor instead of the combination of both used in the first experiment.

The results of these experiments were as shown in the following Table 6.

Table 6

| | Kraft process cooking with dihydroxydihydro-anthracene (0.01%) and sodium fumarate (0.018) | Kraft process cooking with dihydroxydihydro-anthracene (0.02%) | Kraft process cooking with sodium fumarate (0.02%) | Kraft process cooking with neither dihydroxy-dihydroanthracene nor sodium fumarate (conventional Kraft process) |
|---|---|---|---|---|
| Cooking yield | 51.5 | 51.0 | 51.2 | 48.6 |
| Kappa number | 30 | 31 | 30 | 37 |
| Burst factor* | 3.7 | 3.9 | 3.5 | 3.2 |
| Breaking length (Km)* | 4.9 | 5.2 | 4.7 | 4.3 |
| Tear factor* | 85 | 82 | 86 | 86 |

*determined by this P-8210 (Testing Method for Strength of Paper Pulp)

What we claim is:

1. A process for the production of pulp comprising the step of cooking lignocellulosic materials in an alkaline or a sulfite-containing cooking liquor, in the presence of between 0.005 and 1% by weight of a compound selected from the group consisting of maleic acid, sodium maleate, potassium maleate, maleic anhydride, fumaric acid, sodium fumarate, potassium fumarate, mesaconic acid and sodium mesaconate to improve pulp quality and pulp cooking yield.

2. The process as defined in claim 1 in which said compound is used in an amount of 0.01 to 0.1% by weight based on the bone dry weight of the lignocellulosic material.

3. The process of claim 1, wherein the said compound is sodium maleate.

4. The process of claim 3, wherein said compound is in an amount between 0.01 and 0.1% by weight based on the bone-dry weight of the lignocellulosic material.

5. The process of claim 1, wherein the said compound is maleic anhydride.

6. The process of claim 5, wherein said compound is in an amount between 0.01 and 0.1% by weight based on the bone-dry weight of the lignocellulosic material.

7. The process of claim 1, wherein the said compound is sodium fumarate.

8. The process of claim 7, wherein said compound is in an amount between 0.01 and 0.1% by weight based on the bone-dry weight of the lignocellulosic material.

9. The process of claim 1, wherein the said compound is mesaconic acid.

10. The process of claim 9, wherein said compound is in an amount between 0.01 and 0.1% by weight based on the bone-dry weight of the lignocellulosic material.

11. The process of claim 1, wherein the said compound is sodium maleate.

12. The process of claim 11, wherein said compound is in an amount between 0.01 and 0.1% by weight based on the bone-dry weight of the lignocellulosic material.

* * * * *